US010692632B1

(12) United States Patent
Smith et al.

(10) Patent No.: US 10,692,632 B1
(45) Date of Patent: Jun. 23, 2020

(54) SURFACE MOUNT RESISTORS AND METHODS OF MANUFACTURING SAME

(71) Applicant: VISHAY DALE ELECTRONICS, LLC, Columbus, NE (US)

(72) Inventors: Clark Smith, Columbus, NE (US); Todd Wyatt, Columbus, NE (US)

(73) Assignee: VISHAY DALE ELECTRONICS, LLC, Columbus, NE (US)

( * ) Notice: Subject to any disclaimer, the term of this patent is extended or adjusted under 35 U.S.C. 154(b) by 0 days.

(21) Appl. No.: 16/572,052

(22) Filed: Sep. 16, 2019

Related U.S. Application Data

(63) Continuation of application No. 16/139,654, filed on Sep. 24, 2018, now Pat. No. 10,418,157, which is a continuation of application No. 14/928,893, filed on Oct. 30, 2015, now Pat. No. 10,083,781.

(51) Int. Cl.

| | |
|---|---|
| ***H01C 1/032*** | (2006.01) |
| ***H01C 17/00*** | (2006.01) |
| ***H01C 7/18*** | (2006.01) |
| ***H01C 17/28*** | (2006.01) |
| ***H01C 1/084*** | (2006.01) |
| ***H01C 7/06*** | (2006.01) |
| ***H01C 1/148*** | (2006.01) |
| ***H01C 1/144*** | (2006.01) |
| ***H01C 1/142*** | (2006.01) |
| ***H01C 17/065*** | (2006.01) |

(52) U.S. Cl.
CPC ..... *H01C 1/032* (2013.01); *H01C 1/084* (2013.01); *H01C 1/142* (2013.01); *H01C 1/144* (2013.01); *H01C 1/148* (2013.01); *H01C 7/06* (2013.01); *H01C 7/18* (2013.01); *H01C 17/00* (2013.01); *H01C 17/065* (2013.01); *H01C 17/281* (2013.01)

(58) Field of Classification Search
CPC ..... H01C 1/032; H01C 1/144; H01C 1/148; H01C 17/065; H01C 17/281
See application file for complete search history.

(56) References Cited

U.S. PATENT DOCUMENTS

| | | | | |
|---|---|---|---|---|
| 9,859,041 | B2 * | 1/2018 | Yoneda | H01C 1/014 |
| 10,083,781 | B2 * | 9/2018 | Smith | H01C 17/065 |
| 10,418,157 | B2 * | 9/2019 | Smith | H01C 17/065 |
| 2010/0039211 | A1 * | 2/2010 | Wang | B32B 38/0032 338/204 |
| 2013/0025915 | A1 * | 1/2013 | Lin | B32B 37/02 174/254 |

* cited by examiner

*Primary Examiner* — Kyung S Lee
(74) *Attorney, Agent, or Firm* — Volpe and Koenig, P.C.

(57) ABSTRACT

Resistors and a method of manufacturing resistors are described herein. A resistor includes a resistive element and a plurality of conductive elements. The plurality of conductive elements are electrically insulated from one another via a dielectric material and thermally coupled to the resistive element via an adhesive material disposed between each of the plurality of conductive elements and a surface of the resistive element. The plurality of conductive elements is coupled to the resistive element.

14 Claims, 7 Drawing Sheets

SURFACE MOUNT RESISTORS AND METHODS OF MANUFACTURING SAME

CROSS REFERENCE TO RELATED APPLICATION

This application is a continuation of U.S. patent application Ser. No. 16/139,654, filed Sep. 24, 2018, which is a continuation of U.S. patent application Ser. No. 14/928,893, filed Oct. 30, 2015, which issued as U.S. Pat. No. 10,083,781 on Sep. 25, 2018, the entire contents of which are hereby incorporated by reference as if fully set forth herein.

FIELD OF INVENTION

This application relates to the field of electronic components and, more specifically, resistors and the manufacture of resistors.

BACKGROUND

Resistors are passive components used in circuits to provide electrical resistance by converting electrical energy into heat, which is dissipated. Resistors may be used in electrical circuits for many purposes, including limiting current, dividing voltage, sensing current levels, adjusting signal levels and biasing active elements. High power resistors may be required in applications such as motor vehicle controls, and such resistors may be required to dissipate many watts of electrical power. Where those resistors are also required to have relatively high resistance values, such resistors should be made to support resistive elements that are very thin and also able to maintain their resistance values under a full power load over a long period of time.

SUMMARY

Resistors and methods of manufacturing resistors are described herein.

According to an embodiment of the present invention, a resistor includes a resistive element and a plurality of separated conductive elements. The plurality of conductive elements may be electrically insulated from one another via a dielectric material and thermally coupled to the resistive element via an adhesive material disposed between each of the plurality of conductive elements and a surface of the resistive element. The plurality of conductive elements may also be electrically coupled to the resistive element via conductive layers and solderable layers.

According to another aspect of the invention a resistor is provided comprising a resistive element having an upper surface, a bottom surface, a first side surface, and an opposite second side surface. A first conductive element and a second conductive element are joined to the upper surface of the resistive element by an adhesive. A gap is provided between the first conductive element and the second conductive element. The positioning of the first conductive element and the second conductive leave exposed portions of the upper surface of resistive element adjacent the first side surface and the second side surface of the resistive element. A first conductive layer covers the exposed portion of the upper surface of resistive element adjacent the first side surface, and is in contact with the adhesive and the first conductive element. A second conductive layer covers the exposed portion of the upper surface of resistive element adjacent the second side surface, and is in contact with the adhesive and the second conductive element. A third conductive layer is positioned along a bottom portion of the resistive element, adjacent the first side of the resistive element. A fourth conductive layer is positioned along a bottom portion of the resistive element, adjacent the second side of the resistive element. A dielectric material covers upper surfaces of the first conductive element and the second conductive element and fills the gap between the first conductive element and the second conductive element. A dielectric material is deposited on an outer surface of the resistor, and may be deposited on both the top and bottom of the resistor.

A method of manufacturing a resistor is also provided. The method comprises the steps of: laminating a conductor to a resistive element using an adhesive; masking and patterning the conductor to divide the conductor into a plurality of conductive elements; selectively removing portions of the adhesive material from the resistive element; plating the resistive element with one or more conductive layers to electrically couple the resistive element to the plurality of conductive elements; and, depositing a dielectric material on at least the plurality of conductive elements to electrically isolate the plurality of conductive elements from each other.

According to another aspect of the invention a resistor is provided comprising a resistive element, and first and second conductive elements that are electrically insulated from one another by a dielectric material thermally coupled to the resistive element via an adhesive material. A first conductive layer is disposed so as to directly contact a first side surface of the resistive element and a side surface of the first conductive element. A second conductive layer is disposed so as to directly contact a second side surface of the resistive element and a side surface of the second conductive element. First and second solderable layers form lateral sides of the resistor.

BRIEF DESCRIPTION OF THE DRAWINGS

A more detailed understanding may be had from the following description, given by way of example in conjunction with the accompanying drawings wherein.

DETAILED DESCRIPTION

Figure 1A:
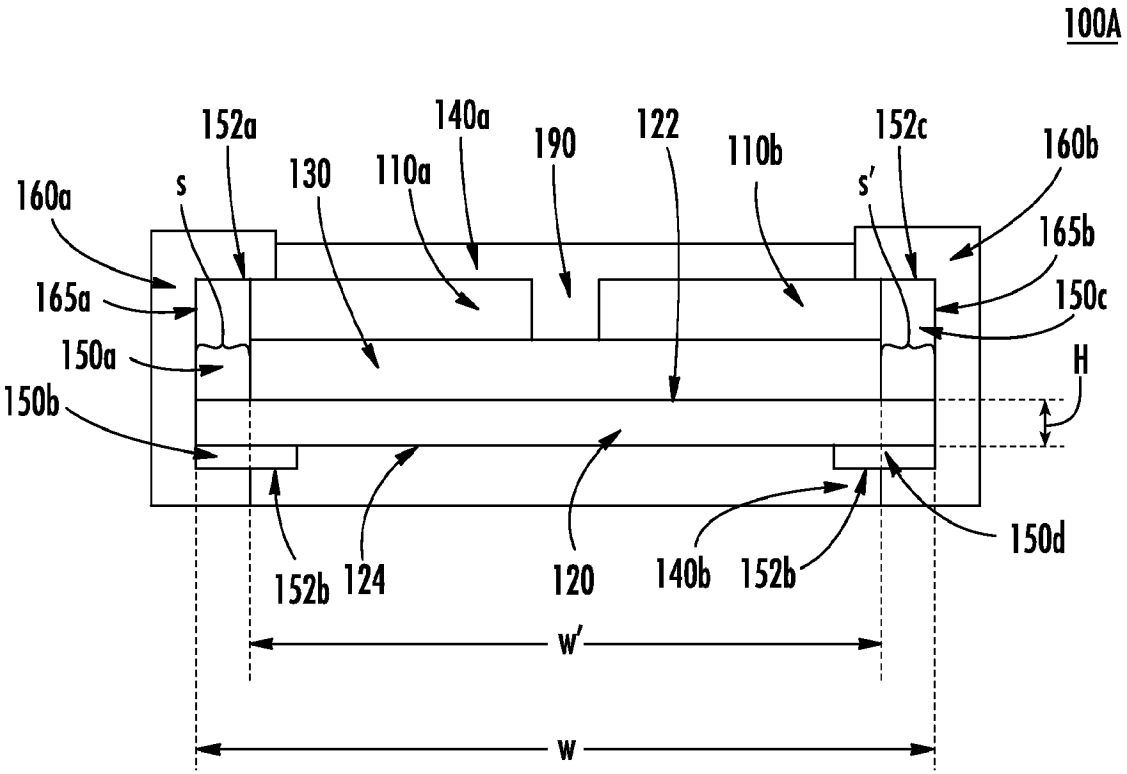
FIG. 1A shows a cross-sectional view of an embodiment of a resistor according to the present invention.

Certain terminology is used in the following description for convenience only and is not limiting. The words "right," "left," "top," and "bottom" designate directions in the drawings to which reference is made. The words "a" and "one," as used in the claims and in the corresponding portions of the specification, are defined as including one or more of the referenced item unless specifically stated otherwise. This terminology includes the words above specifically mentioned, derivatives thereof, and words of similar import. The phrase "at least one" followed by a list of two or more items, such as "A, B, or C," means any individual one of A, B or C as well as any combination thereof.

FIG. 1A is a diagram of an illustrative resistor 100 (designated as 100A in FIG. 1A and 100B in FIG. 1B) according to an embodiment of the present invention. The resistor 100A illustrated in FIG. 1 includes a resistive element 120 positioned across the resistor, and between a first solderable layer 160*a* and a second solderable layer 160*b*, described in greater detail below. In the orientation shown in FIG. 1A for illustrative purposes, the resistive element has a top surface 122 and a bottom surface 124. The resistive element 120 is preferably a foil resistor. The resistive element may be formed from, by way of non-limiting example, copper, alloys of copper, nickel, aluminum, or manganese, or combinations thereof. The resistive element may be formed from alloys of copper-nickel-manganese (CuNiMn), nickel-chromium-aluminum (NiCrAl), or nickel-chromium (NiCr), or other alloys known to those of skill in the art acceptable for use as a foil resistor. The resistive element 120 has a width designated in FIG. 1A as "w". In addition, the resistive element 120 has a height or thickness designated in FIG. 1A as height "H".

As shown in FIG. 1A, a first conductive element 110*a* and a second conductive element 110*b* are positioned adjacent opposite side ends of the resistive element 120, with a gap 190 preferably provided between the first conductive element 110*a* and a second conductive element 110*b*. The conductive elements 110*a* and 110*b* may preferably comprise copper, such as, for example, C110 or C102 copper. However, other metals with good heat transfer properties, such as, for example, aluminum, may be used for the conductive elements, and those of skill in the art will appreciate other acceptable metals for use as the conductive elements. Preferably, the first conductive element 110*a* and a second conductive element 110*b* do not extend all the way to the outer side edges (or outer side surfaces) of the resistive element 120, and leave spaces s and s' adjacent the edges of the resistive element 120. Exposed portions of the upper surface 122 of the resistive element 120 face each of the spaces s and s' adjacent the side edges of the resistive element 120.

The conductive elements 110*a* and 110*b* may be laminated to or otherwise bonded, joined or attached to the resistive element 120 via an adhesive material 130, which may comprise, by way of non-limiting example, materials such as DUPONT™ PYRALUX™, or other acrylic, epoxy, or polyimide adhesives in sheet or liquid form. As shown in FIG. 1A, the adhesive material 130 preferably extends only along a central portion of the resistive element, from a side edge of the first conductive element 110*a*, to the opposite side edge of the second conductive element 110*b*. The first conductive element 110*a*, second conductive element 110*b*, and adhesive material 130 extend along a width adjacent the top surface 122 of the resistive element 120 designated as w'.

A first conductive layer 150*a* and a second conductive layer 150*c* are provided in the spaces s and s', adjacent the top surface 122 of the resistive element 120 and along the outer side edges (or outer side surfaces) of the conductive elements 110*a* and 110*b* in order to provide an electrical connection with them. Preferably, the first conductive layer 150*a* and the second conductive layer 150*c* are plated to the top surface 122 of the resistive element and along the outer side edges (or outer side surfaces) of the conductive elements 110*a* and 110*b*. In a preferred embodiment, copper may be used for the conductive layers. However, any platable and highly conductive metals may be used, as will be appreciated by those of skill in the art.

As shown in FIG. 1A, additional third 150*b* and fourth 150*d* conductive layers are disposed adjacent opposite side ends and along at least portions of the bottom surface 124 of the resistive element 120. The conductive layers 150*b* and 150*d* have opposite outer edges that preferably align with the opposite outer side edges (or outer side surfaces) of resistive element 120, and the opposite outer side edges (or outer side surfaces) of first conductive layer 150*a* and a second conductive layer 150*c*. Preferably, the third 150*b* and fourth 150*d* conductive layers are plated to the bottom surface 124 of the resistive element 120.

The aligned outer side edges (or outer side surfaces) of the resistive element 120 and the outer side edges (or outer side surfaces) of the conductive layers 150*a*, 150*b*, 150*c*, 150*d*, form solderable surfaces configured to receive solderable layers. Solderable layers 160*a* and 160*b* may be separately attached at the lateral ends 165*a* and 165*b* of the resistor 100A to allow the resistor 100A to be soldered to a circuit board, which is described in more detail below with respect to FIG. 1B. As shown in FIG. 1A, the solderable layers 160*a* and 160*b* preferably include portions that extend at least partially along bottom surfaces 152*b* and 152*d* of the conductive layers 150*b* and 150*d*. As shown in FIG. 1A, the solderable layers 160*a* and 160*b* preferably include portions that extend along upper surfaces 152*a* and 152*c* of the conductive layers 150*a* and 150*c*, and also at least partially along an upper surface of the conductive elements 110*a* and 110*b*.

A dielectric material 140 may be deposited on a surface or surfaces of the resistor 100, for example, by coating. The dielectric material 140 may fill spaces or gaps to electrically isolate components from each other. As shown in FIG. 1A, a first dielectric material 140*a* is deposited on an upper portion of the resistor. The first dielectric material 140*a* preferably extends between portions of the solderable layers 160*a* and 160*b*, and covers the exposed upper surfaces of the conductive elements 110*a* and 110*b*. The first dielectric material 140*a* also fills in the gap 190 between the conductive elements 110*a* and 110*b*, covering the exposed portion of the adhesive 130 facing the gap 190. A second dielectric material 140*b* is deposited along the bottom surface of the resistive element 120, between portions of the solderable layers 160*a* and 160*b*, and covering exposed portions of the conductive layers 150*b* and 150*d*, and the bottom surface 124 of the resistive element 120.

Figure 1B:
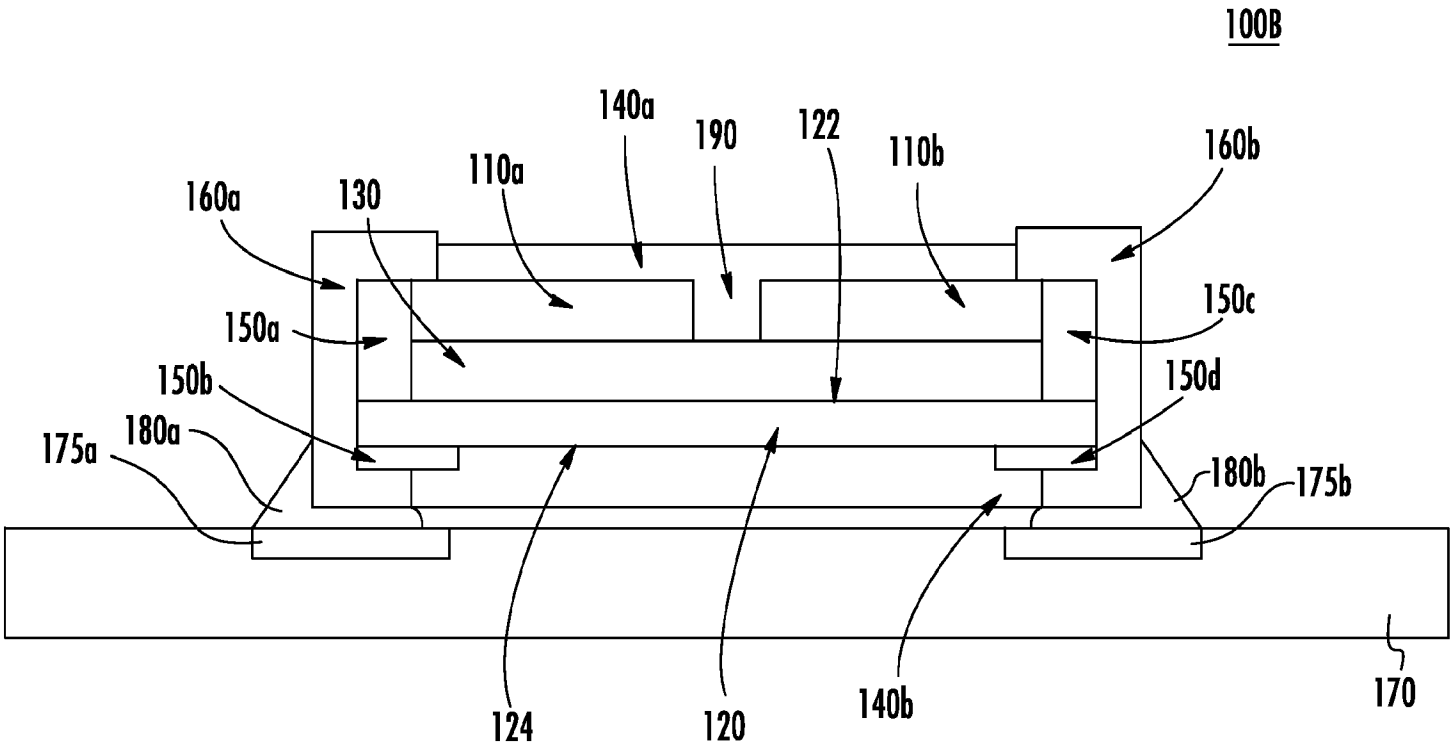
FIG. 1B shows the resistor of FIG. 1A mounted on a circuit board.

FIG. 1B is a diagram of an illustrative resistor 100B mounted on a circuit board 170. The resistor 100B is identical to the resistor 100A, and same parts are given the same numbering in FIG. 1B. In the example illustrated in FIG. 1B, the resistor 100B is mounted to the circuit board 170 using solder connections 180*a* and 180*b* between the solderable layers 160*a* and 160*b* and corresponding solder pads 175*a* and 175*b* on the circuit board 170.

The conductive elements 110*a* and 110*b* are coupled to the resistive element 120 via the adhesive 130 and connected to the resistive element at its lateral or outer side ends or surfaces via the conductive layer 150*a* and 150*c*. It is appreciated that the conductive elements 110*a* and 110*b* may be thermally and/or mechanically and/or electrically coupled/connected or otherwise bonded, joined or attached to the resistive element 120. It is further appreciated that the conductive elements 110*a* and 110*b* may be thermally and/or mechanically and/or electrically coupled/connected or otherwise bonded, joined or attached to the conductive layers 150*a* and 150*c*. Of particular note, the conductive layer 150*a* and 150*c* makes the electrical connection between the resistive element 120 and the conductive elements 110*a* and 110*b* from the surface 122 of the resistive element that is farthest from the circuit board 170 when the resistor 100B is mounted thereon. The thermal, electrical, and/or mechanical coupling/connection between the resistive element 120 and the lateral end of each of the conductive elements 110*a* and 110*b* may enable the conductive elements 110*a* and 110*b* to be used both as supports for the resistive element 120 and also as a heat spreader. Use of the conductive elements 110*a* and 110*b* as a support for the resistive element 120 may enable the resistive element 120 to be made thinner as compared to self-supporting resistive elements, enabling the resistor 100B to be made to have a resistance values of 1 mΩ to 20Ω using foil thicknesses between about 0.015" and about 0.001". In addition to providing support for the resistive element 120, efficient use of the conductive elements 110*a* and 110*b* as a heat spreader may enable the resistor 100B to dissipate higher powers as compared to resistors that do not use a heat spreader. For example, a typical power rating for a 2512 size metal strip resistor is 1 W. Using the embodiments described herein, the power rating for a 2512 size metal strip resistor may be 3 W.

Further, making the electrical connection between the resistive element 120 and the conductive elements 110*a* and 110*b* on a surface of the resistive element that is farthest from the circuit board 170 may avoid exposure of the resistive-element-to-conductive-element-connection to the solder joint between the resistor 100 and the circuit board 170, which may reduce or eliminate risk of failure of the resistor due to the thermal coefficient of expansion (TCE). Further, the use of a conductive layer, such as 150*b* and 150*d*, on the side of the resistive element that is closest to the PCB may aid in creating a strong solder joint and centering the resistor on the PCB pads during solder reflow.

Examples of other resistor designs and methods of manufacturing them are described below with respect to FIGS. 2, 3, 4, 5 and 6 to illustrate different designs that may achieve the same general design goals as the resistors 100A, 100B. However, one of ordinary skill in the art will understand that other resistor designs and manufacturing methods may be made within the scope of this disclosure.

Figure 2:
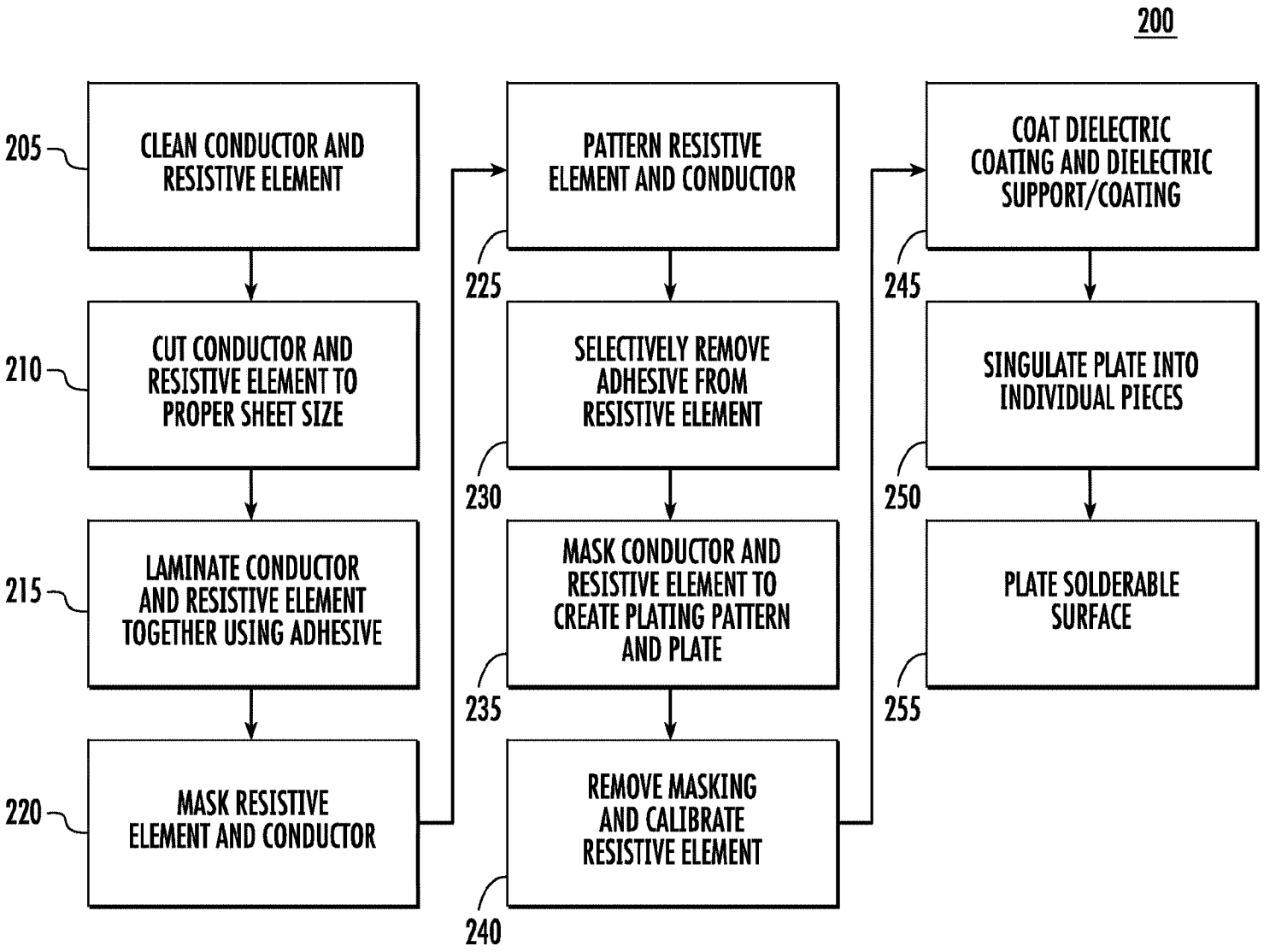
FIG. 2 shows a flow diagram of an example method of manufacturing the resistor of FIG. 1A.

FIG. 2 is a flow diagram of an illustrative method 200 of manufacturing the resistor of FIG. 1. In the example method illustrated in FIG. 2, a conductive layer and the resistive element 120 may be cleaned (205) and cut, for example, to a desired sheet size (210). The conductive layer and the resistive element 120 may be laminated together using an adhesive material 130 (215). The resistive element 120 and the conductive layer may be masked (220) and patterned (225) as desired. In the example resistor 100, masking and patterning of the conductive layer may be used, for example, to separate the conductive layer to form conductive elements 110*a* and 110*b*. At least some of the adhesive material 130 may be selectively removed from the surface 122 of the resistive element 120 (230), for example, to make space for the conductive layer 150*a* and 150*c* that will make the electrical connection between the resistive element 120 and the conductive elements 110*a* and 110*b*.

The conductive elements 110*a* and 110*b* and the resistive element 120 may be masked, as desired, to create a plating pattern and then may be plated (235). The plating may be used, for example, to deposit one or more of the conductive layers 150*a*, 150*b*, 150*c* and 150*d*. Once the plating is completed, the masking may be removed so that the resistive element may be calibrated (240), for example, by thinning a resistive foil to a desired thickness or by manipulating the current path by cutting through the resistive foil in specific locations based, for example, on the target resistance value for the resistor. A dielectric material 140 is deposited on the top, bottom, or both top and bottom surfaces of the resistor 100. The dielectric material 140 is preferably deposited on exposed upper surfaces of the conductive elements 110*a* and 110*b* (245), for example, by coating. The dielectric material 140*a* may fill any space between the conductive elements 110*a* and 110*b* to electrically isolate them from one another. A plate formed by the method may then be singulated into individual pieces to form individual resistors 100 (250). Solderable layers 160*a* and 160*b* may then be attached to, or formed on, the lateral edges 165*a* and 165*b* of the individual resistors 100, for example, by plating (255).

Figure 3:
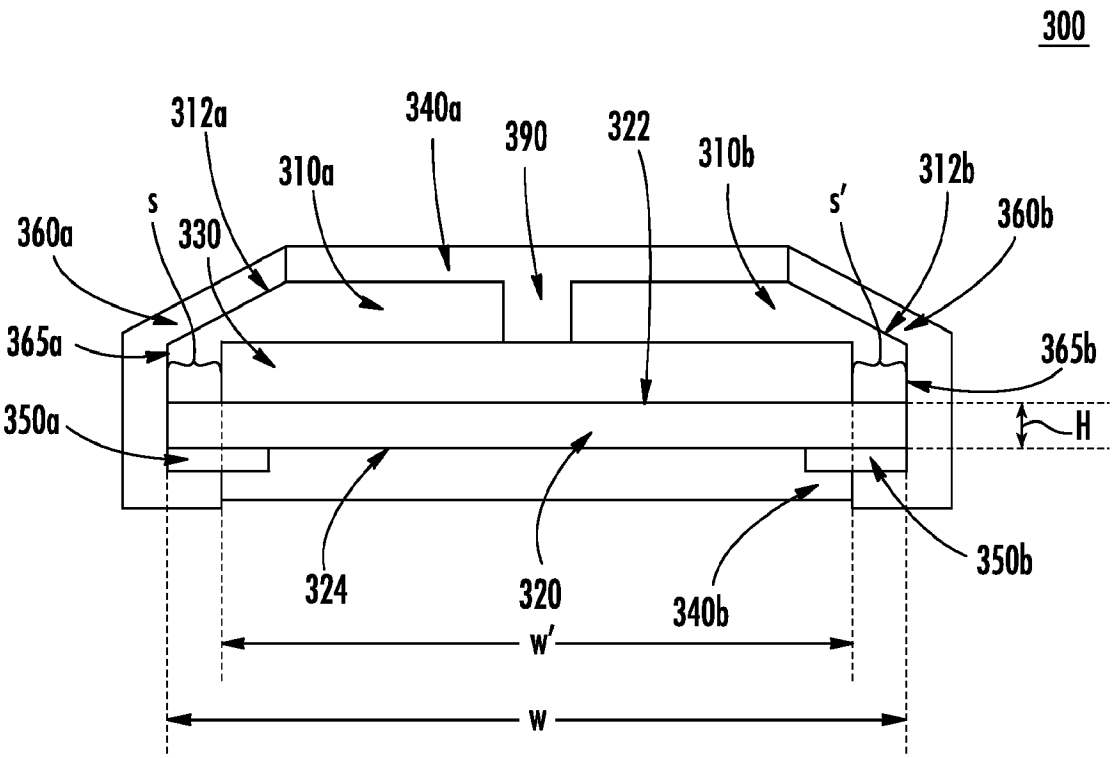
FIG. 3 shows a cross-sectional view of an embodiment of a resistor according to the present invention.

FIG. 3 is a diagram of another illustrative resistor 300 according to an embodiment of the present invention. Similar to resistor 100, resistor 300 illustrated in FIG. 3 includes a resistive element 320 positioned across the resistor, and between a first solderable layer 360*a* and a second solderable layer 360*b*, described in greater detail below. In the orientation shown in FIG. 3 for illustrative purposes, the resistive element 320 has a top surface 322 and a bottom surface 324. The resistive element is preferably a foil resistor. The resistive element 320 has a width designated in FIG. 3 as w. In addition, the resistive element 320 has a height or thickness designated in FIG. 3 as height "H". Exposed portions of the upper surface 322 of the resistive element 320 face each of the spaces s and s' adjacent the side edges of the resistive element 320.

As shown in FIG. 3, a first conductive element 310*a* and a second conductive element 310*b* are positioned adjacent opposite side ends of the resistive element 320 with a gap 390 preferably provided between the first conductive element 310*a* and the second conductive element 310*b*. The conductive elements 310*a* and 310*b* may preferably comprise copper.

The conductive elements 310*a* and 310*b* may be laminated to or otherwise joined or attached to the resistive element 320 via an adhesive material 330. As shown in FIG. 3, the adhesive material 330 preferably extends only along a central portion of the resistive element, extending along a width adjacent the top surface of the resistive element 320 designed at w'.

The conductive elements 310*a* and 310*b* are shaped such that each conductive element 310*a* and 310*b* extends along a portion of the top surface 322 of the resistive element 320, from an outer edge of the gap 390 to a respective outer edge of the adhesive 330, and each has a portion that angles outwardly and downwardly toward the resistive element 320, to be positioned in the spaces s and s' and directly contacting the top surface 322 of the resistive element 320. The angled portions of the conductive elements 310*a* and 310*b* are preferably positioned and arranged to provide for intimate contact, electrically, thermally and mechanically, between of the conductive elements 310*a* and 310*b* and the surface 322 of the resistive element 320 in the area designated as s, and to provide for intimate contact, electrically, thermally and mechanically, between the conductive elements 310*a* and 310*b* and the surface 322 of the resistive element 320 in the area designated as s'. The shape of the upper portions 312*a* and 312*b* of the conductive elements 310*a* and 310*b* can be varied, and can range from a barely perceptible step, to a rounding such as a rounded edge, to an angle having a slope that could be from a few degrees to somewhat less than 90 degrees, so long as the areas provide for intimate contact as described.

As shown in FIG. 3, first 350*a* and second 350*b* conductive layers are disposed along opposite side ends along the bottom surface 324 of the resistive element 320. The conductive layers 350*a* and 350*b* have opposite outer edges that preferably align with the opposite outer edges of resistive element 320, and the opposite outer edges of the conductive elements 310*a* and 310*b*. Preferably, the first 350*a* and second 350*b* conductive layers are plated to the bottom surface 324 of the resistive element 320.

The outer side edges (or outer side surfaces) of the resistive element 320, the outer sides of the conductive elements 310*a*, 310*b*, and the outer side edges (or outer side surfaces) of conductive layers 350*a* and 350*b*, form solderable surfaces configured to receive solderable layers. Solderable layers 360*a* and 360*b* may be attached at the lateral ends 365*a* and 365*b* of the resistor 300 to allow the resistor 300 to be soldered to a circuit board. As shown in FIG. 3, the solderable layers 360*a* and 360*b* preferably include portions that extend along the shaped upper portions 312*a* and 312*b* of the conductive elements 310*a* and 310*b*, at least partially along an upper surface of the conductive elements 310*a* and 310*b*, and also at least partially along a bottom surface of the conductive layers 350*a* and 350*b*.

A dielectric material 340 may be deposited surfaces of the resistor 300, for example, by coating. The dielectric material 340 may fill spaces or gaps to electrically isolate components from each another. As shown in FIG. 3, a first dielectric material 340*a* is deposited on an upper portion of the resistor 300. The first dielectric material 340*a* preferably extends between portions of the solderable layers 360*a* and 360*b*, and covers the exposed upper surfaces of the conductive elements 310*a* and 310*b*. The first dielectric material 340*a* also fills in the gap 390 between the conductive elements 310*a* and 310*b*, covering the exposed portion of the adhesive 330 facing the gaps 390. A second dielectric material 340*b* is deposited along the bottom surface of the resistive element 320, between portions of the solderable layers 360*a* and 360*b*, and covering exposed portions of the conductive layers 350*a* and 350*d*, and the bottom surface 324 of the resistive element 320.

Figure 4:
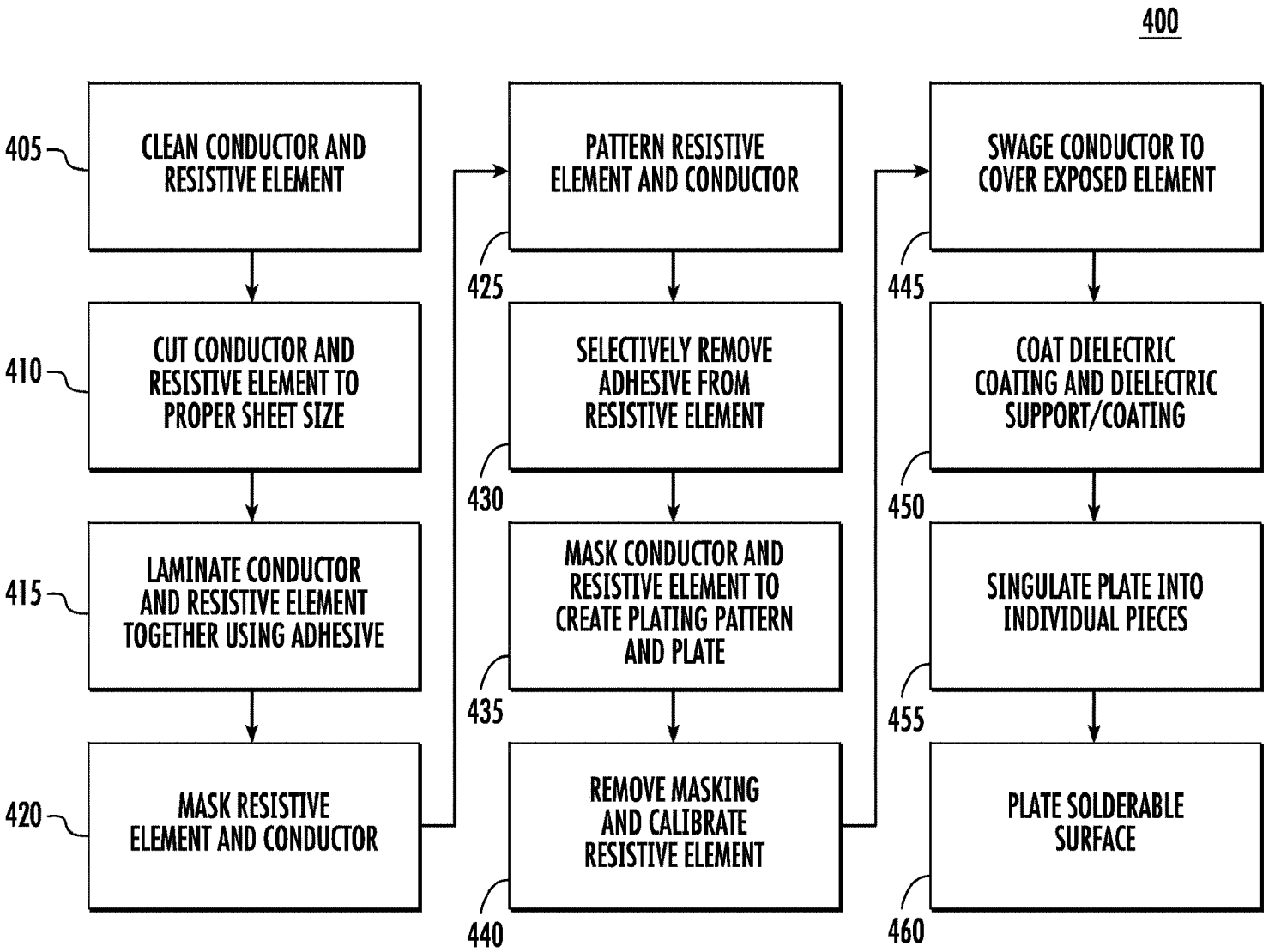
FIG. 4 is a flow diagram of an example method of manufacturing the resistor of FIG. 3.

FIG. 4 is a flow diagram of an example method 400 of manufacturing the resistor 300. In the example method illustrated in FIG. 4, a conductive layer and the resistive element 320 may be cleaned (405) and cut, for example, to a desired sheet size (410). The conductive layer and the resistive element 320 may be laminated together using an adhesive material 330 (415). The resistive element 320 and the conductive layer may be masked (420) and patterned (425) as desired. In the example resistor 300, masking and patterning of the conductive layer may be used, for example, to separate the conductive layer to form conductive elements 310*a* and 310*b*. At least some of the adhesive material 330 may be selectively removed from the surface 322 of the resistive element 320 (430), for example, to make space for a direct connection with the conductive elements 310*a* and 310*b*.

The conductive elements 310*a* and 310*b* and the resistive element 320 may be masked, as desired, to create a plating pattern and then may be plated (435). The plating may be used, for example, to deposit one or more of the conductive layer 350*a* and 350*b* on the surface 324 of the resistive element 320. Once the plating is completed, the masking may be removed so that the resistive element may be calibrated (440), for example, by thinning a resistive foil to a desired thickness or by manipulating the current path by cutting through the resistive foil in specific locations based, for example, on the target resistance value for the resistor. The conductive elements 310*a* and 310*b* may then be swaged to cover the portions of the surface 322 of the resistive element 320 that were exposed by the selective removing of the adhesive material 330 (445).

A dielectric material 340 may be deposited on one or both of the bottom surface 324 of the resistive element 320, and the conductive elements 310*a* and 310*b* (450), for example, by coating. The dielectric material 340*a* may fill any space between the conductive elements 310*a* and 310*b* to electrically isolate them from one another. A plate formed by the method may then be singulated into individual pieces to form individual resistors 300 (455). Solderable layers 360*a* and 360*b* may then be attached to, or formed on, the lateral edges 365*a* and 365*b* of the individual resistors 300, for example, by plating (460).

Figure 5:
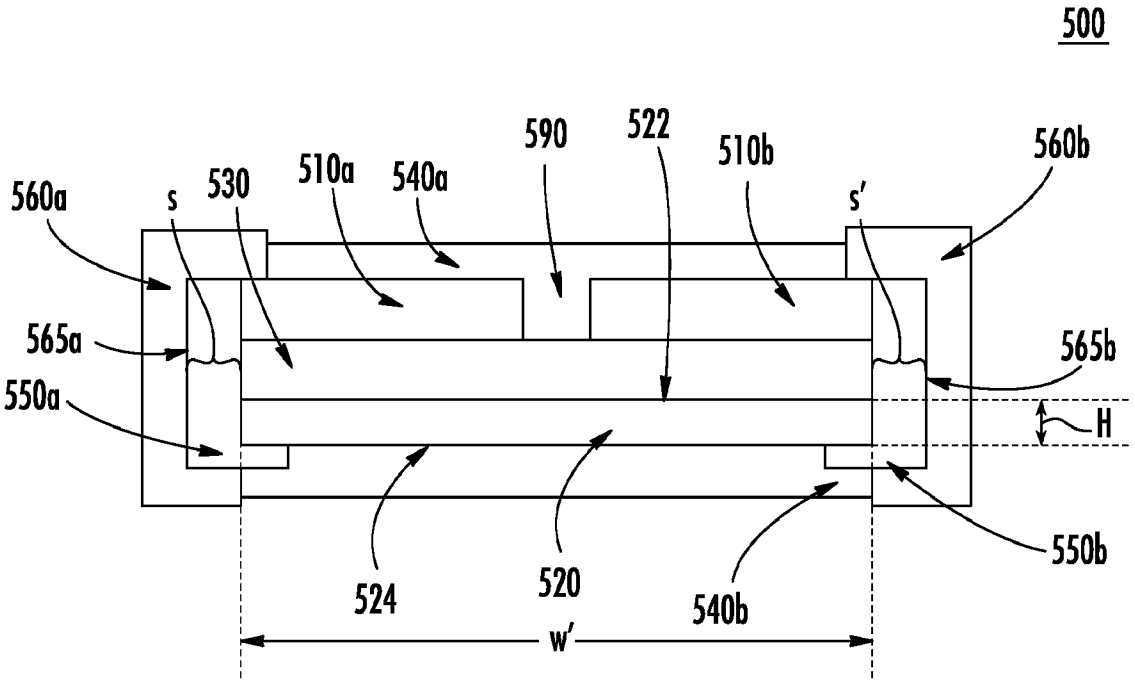
FIG. 5 shows a cross-sectional view of an embodiment of a resistor according to the present invention.

FIG. 5 is a diagram of another illustrative resistor 500 according to an embodiment of the present invention. Similar to the resistors 100 and 300, the resistor 500 illustrated in FIG. 5 includes a resistive element 520 positioned across the resistor, and between a first solderable layer 560*a* and a second solderable layer 560*b*, described in greater detail below. In the orientation shown in FIG. 5 for illustrative purposes, the resistive element has a top surface 522 and a bottom surface 524. The resistive element 520 is preferably a foil resistor. The resistive element 520 has a width designated in FIG. 5 as w'. In addition, the resistive element 520 has a height or thickness designated in FIG. 5 as height "H". Exposed sides of the resistive element 520 face each of the spaces designated as s and s' in FIG. 5 adjacent the side edges of the resistive element 520.

As shown in FIG. 5, a first conductive element 510*a* and a second conductive element 510*b* are positioned adjacent opposite side ends of the resistive element 520, with a gap 590 preferably provided between the first conductive element 510*a* and a second conductive element 510*b*. The conductive elements 510*a* and 510*b* may preferably comprise copper. Preferably, the first conductive element 510*a* and a second conductive element 510*b* are aligned with the outer edges of the resistive element 520.

The conductive elements 510*a* and 510*b* may be laminated to or otherwise joined or attached to the resistive element 520 via an adhesive material 530. As shown in FIG. 5, the adhesive material 530 preferably extends along the entire upper surface 522 of the resistive element 520. The resistive element 520 and the adhesive material 530 have a width designated as w'.

A first conductive layer 550*a* and a second conductive layer 550*b* are provided in spaces s and s', along the outer side edges (or outer side surfaces) of the resistive element 520, the adhesive 530 and each of the conductive elements 510*a* and 510*b* in order to make an electrical connection between them. Preferably, the first conductive layer 550*a* and the second conductive layer 550*b* are plated to the bottom surface 524 of the resistive element 520 and along the outer edges of the resistive element 520 and the conductive elements 510*a* and 510*b*.

The aligned outer side edges (or outer side surfaces) of the resistive element 520, adhesive material 530, and conductive layers 550*a*, 550*b*, form solderable surfaces configured to receive solderable layers. Solderable layers 560*a* and 560*b* may be separately attached at the lateral ends 565*a* and 565*b* of the resistor 500 to allow the resistor 500 to be soldered to a circuit board. As shown in FIG. 5, the solderable layers 560*a* and 560*b* preferably include portions that extend at least partially along bottom surfaces of the conductive layers 550*a* and 550*b*, and also at least partially along an upper surface of the conductive layers 550*a* and 550*b* and the conductive elements 510*a* and 510*b*.

A dielectric material 540 may be deposited on surfaces of the resistor 500, for example, by coating. The dielectric material 540 may fill spaces or gaps to electrically isolate them from one another. As shown in FIG. 5, a first dielectric material 540*a* is deposited on an upper portion of the resistor. The first dielectric material 540*a* preferably extends between portions of the solderable layers 560*a* and 560*b*, and covers the exposed upper surfaces of the conductive elements 510*a* and 510*b*. The first dielectric material 540*a* also fills in the gap 590 between the conductive elements 510*a* and 510*b*, covering the exposed portion of the adhesive 530 facing the gap 590. A second dielectric material 540*b* is deposited along the bottom surface of the resistive element 520, between portions of the solderable layers 560*a* and 560*b*, and covering exposed portions of the conductive layers 550*a* and 550*b*, and bottom surface 524 of the resistive element 520.

Figure 6:
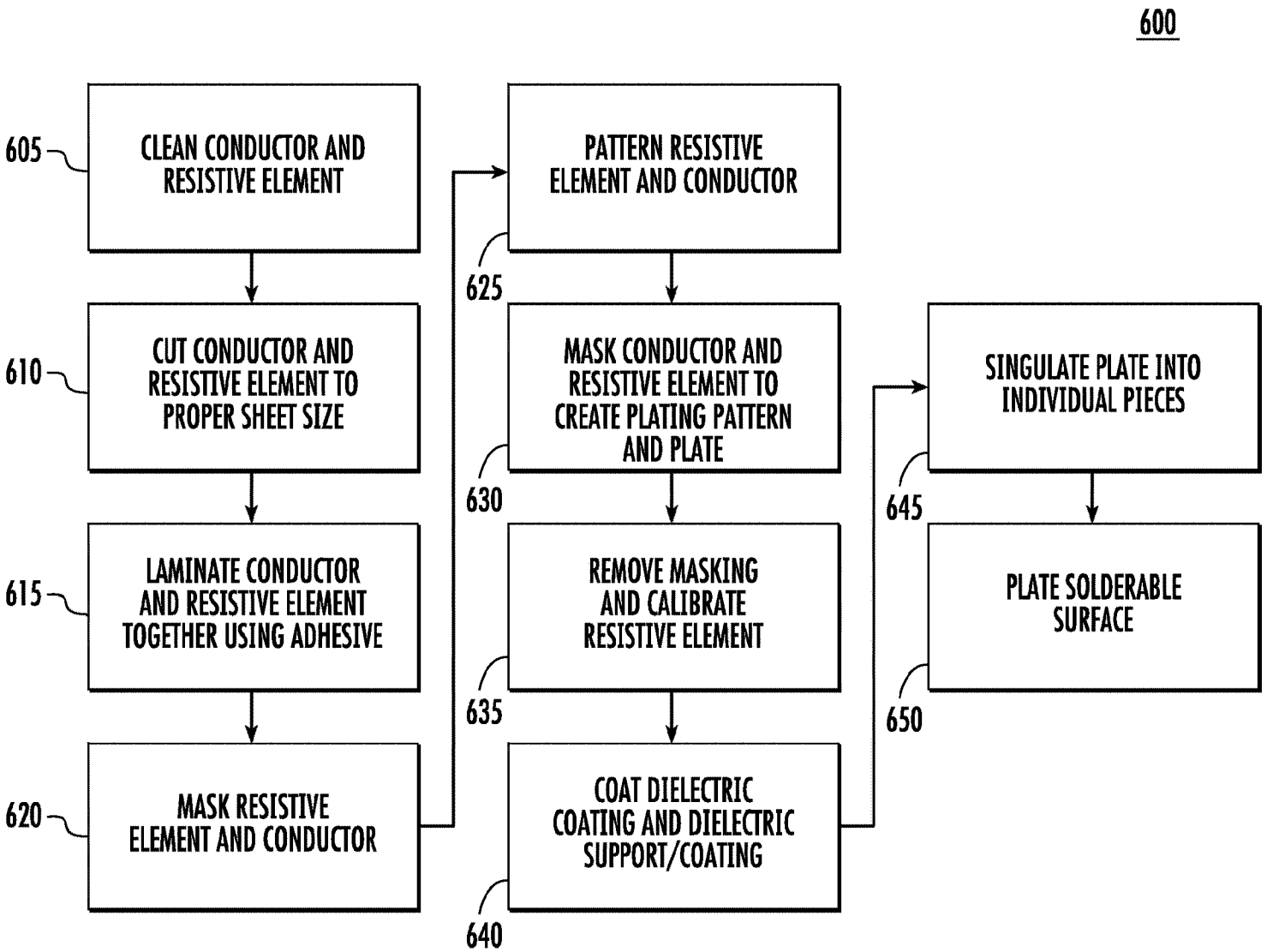
FIG. 6 is a flow diagram of an example method of manufacturing the resistor of FIG. 5.

FIG. 6 is a flow diagram of an example method of manufacturing the resistor 500. In the example method illustrated in FIG. 6, a conductive layer and the resistive element 520 may be cleaned (605) and cut, for example, to a desired sheet size (610). The conductive layer and the resistive element 520 may be laminated together using an adhesive material 530 (615). The resistive element 520 and the conductive layer may be masked (620) and patterned (625) as desired. In the example resistor 500, masking and patterning of the conductive layer may be used, for example, to separate the conductive layer to form conductive elements 510*a* and 510*b*.

The conductive elements 510*a* and 510*b* and the resistive element 520 may be masked, as desired, to create a plating pattern and then may be plated (630). The plating may be used, for example, to deposit one or more of the conductive layer 550*a* and 550*b*. Once the plating is completed, the masking may be removed so that the resistive element may be calibrated (635), for example, by thinning a resistive foil to a desired thickness or by manipulating the current path by cutting through the resistive foil in specific locations based, for example, on the target resistance value for the resistor. A dielectric material 540 may be deposited on one or both of the resistive element 520, and the conductive elements 510*a* and 510*b* (640) (e.g., by coating). The dielectric material 540*a* may fill any space between the conductive elements 510*a* and 510*b* to electrically isolate them from one another. A plate formed by the method may then be singulated into individual pieces to form individual resistors 500 (645). Solderable layers 560*a* and 560*b* may then be attached to, or formed on, the lateral edges 565*a* and 565*b* of the individual resistors 500, for example, by plating (650). In the embodiments illustrated in FIGS. 5 and 6, the adhesive material 530 may be sheared during singulation, eliminating the need to remove certain adhesive materials, such as Kapton, in a secondary lasing operation to expose the resistive element before plating.

Although the features and elements of the present invention are described in the example embodiments in particular combinations, each feature may be used alone without the other features and elements of the example embodiments or in various combinations with or without other features and elements of the present invention.

What is claimed is:

1. A resistor comprising:

a resistive element having an upper surface, an opposite bottom surface, a first side, and an opposite second side; and a first conductive layer adjacent the first side of the resistive element, the first conductive layer having a bottom surface at least a portion of which is thermally coupled to the upper surface of the resistive element by an adhesive, an outer portion of the first conductive layer swaged in an area adjacent the first side of the resistive element, a bottom surface of the outer portion of the first conductive layer extending toward the resistive element;

a second conductive layer adjacent the second side of the resistive element and separated by a gap from the first conductive layer, the second conductive layer having a bottom surface at least a portion of which is thermally coupled to the upper surface of the resistive element by an adhesive, an outer portion of the second conductive layer swaged in an area adjacent the second side of the resistive element, a bottom surface of the outer portion of the second conductive layer extending toward the resistive element;

a first electrode layer positioned along the bottom surface of the resistive element, adjacent the first side of the resistive element; and a second electrode layer positioned along the bottom surface of the resistive element, adjacent the second side of the resistive element.

2. The resistor of claim 1, further comprising:

a first solderable layer covering a first side of the resistor, the first solderable layer in contact with the first conductive layer, the resistive element, and the first electrode layer; and, a second solderable layer covering a second side of the resistor, the second solderable layer in contact with the second conductive layer, the resistive element, and the second electrode layer.

3. The resistor of claim 2, wherein the first solderable layer covers at least a portion of an upper surface of the first conductive layer, and at least a portion of a bottom surface of the first electrode layer.

4. The resistor of claim 3, wherein the second solderable layer covers at least a portion of an upper surface of the second conductive layer, and at least a portion of a bottom surface of the second electrode layer.

5. The resistor of claim 1, wherein each of the first conductive layer and the second conductive layer has upper and outer corners that are stepped, angled or rounded.

6. The resistor of claim 1, wherein the outer portions of each of the first conductive layer and the second conductive layer have a first height above an upper surface of the adhesive, and wherein inner portions of each of the first conductive layer and the second conductive layer have a second height above an upper surface of the adhesive greater than the first height.

7. The resistor of claim 1, wherein an outer portion of the bottom surface of the first conductive layer is positioned closer to the first electrode layer than an inner portion of the bottom surface of the first conductive layer, and wherein an outer portion of the bottom surface of the second conductive layer is positioned closer to the second electrode layer than an inner portion of the bottom surface of the second conductive layer.

8. A method of manufacturing a resistor, the method comprising:

providing a resistive element having an upper surface, a bottom surface, a first side, and an opposite second side; and thermally coupling a first conductive layer to the upper surface of the resistive element adjacent the first side of the resistive element by an adhesive;

thermally coupling a second conductive layer to the upper surface of the resistive element adjacent the second side of the resistive element by an adhesive;

swaging an outer portion the first conductive layer so as to position an outer portion of a bottom surface of the first conductive layer in proximity to the resistive element in an area adjacent the first side of the resistive element;

swaging an outer portion the second conductive layer so as to position an outer portion of a bottom surface of the second conductive layer in proximity to the resistive element in an area adjacent the second side of the resistive element;

providing a first electrode layer along the bottom surface of the resistive element, adjacent the first side of the resistive element; and providing a second electrode layer positioned along the bottom surface of the resistive element, adjacent the second side of the resistive element.

9. The method of claim 8, further comprising the steps of:

plating a first solderable layer to a first side of the resistor, the first solderable layer in contact with the first conductive layer, the resistive element, and the first electrode layer; and, plating a second solderable layer to a second side of the resistor, the second solderable layer in contact with the second conductive layer, the resistive element, and the second electrode layer.

10. The method of claim 9, wherein the first solderable layer covers at least a portion of an upper surface of the first conductive layer, and at least a portion of a bottom surface of the first electrode layer.

11. The method of claim 10, wherein the second solderable layer covers at least a portion of an upper surface of the second conductive layer, and at least a portion of a bottom surface of the second electrode layer.

12. The method of claim 8, further comprising forming upper and outer corners of each of the first conductive layer and the second conductive layer as stepped, angled or rounded.

13. The method of claim 8, further comprising forming each of the first conductive layer and the second conductive layer having the outer portions at a first height above an upper surface of the adhesive, and each of the first conductive layer and the second conductive layer having inner portions at a second height above an upper surface of the adhesive greater than the first height.

14. The method of claim 8, further comprising positioning an outer portion of the bottom surface of the first conductive layer closer to the first electrode layer than an inner portion of the bottom surface of the first conductive layer, and positioning an outer portion of the bottom surface of the second conductive layer closer to the second electrode layer than an inner portion of the bottom surface of the second conductive layer.

* * * * *